US006119591A

United States Patent [19]

Chen

[11] Patent Number: 6,119,591

[45] Date of Patent: Sep. 19, 2000

[54] PROCESSING METHOD FOR UNDETACHABLY PRINTING PICTURES ON SURFACE OF A FASTENING SHEATH FOR SHOE LACE HEAD

[75] Inventor: Paul Chen, Changhau Hsien, Taiwan

[73] Assignee: Taiwan Paiho Limited, Changhau Hsien, Taiwan

[21] Appl. No.: 09/006,180

[22] Filed: Jan. 13, 1998

[51] Int. Cl.[7] ..... B41F 17/08

[52] U.S. Cl. ..... 101/35; 24/715.7

[58] Field of Search ..... 101/35; 24/715.4, 24/715.6, 715.7

[56] References Cited

U.S. PATENT DOCUMENTS 1,512,162 10/1924 Dennis ..... 24/715.7

*Primary Examiner*—Edgar Burr
*Assistant Examiner*—Amanda B. Sandusky
*Attorney, Agent, or Firm*—Browdy and Neimark

[57] ABSTRACT

A processing method for undetachably printing pictures on the surface of a fastening sheath for a shoe lace head, including the steps of: processing acetic acid fiber at high temperature and then pressing the fiber into transparent film which is wound into a roll of film; printing one side of the film with necessary colorful pictures by general ink printing technique; printing two liquid transparent inks onto the side of the film to cover the colorful pictures as a protective coating for protecting the colorful pictures from being corroded by chemical adhesive agents; and by means of a fixed mold and a movable mold, which are unifiedly operated at a certain temperature, placing the head section of the shoe lace on the fixed mold and spraying chemical adhesive agents such as MEK, acetone, toluene, etc. thereon. The roll of film is then cut off into a segment of film having a certain length with the necessary colorful pictures. Then the head section of the shoe lace is wrapped and fastened by the segment of the film to form a fastening sheath for the shoe lace head.

1 Claim, 2 Drawing Sheets

PROCESSING METHOD FOR UNDETACHABLY PRINTING PICTURES ON SURFACE OF A FASTENING SHEATH FOR SHOE LACE HEAD

BACKGROUND OF THE INVENTION

1. Technical Field of the Invention

The Present invention relates to a processing method for undetachably printing pictures on the surface of a fastening sheath for a shoe lace head, in which one side of a roll of film is printed with necessary colorful pictures by general ink and then two liquid transparent inks are further printed onto this side as a protective coating for protecting the colorful pictures from being corroded and evaporized by chemical adhesive agents.

2. Prior Art

The existing method for manufacturing a fastening sheath for a shoe lace head includes the steps of: printing one side of a roll of film with pictures by an ink; by means of a fixed mold and a movable mold, which are unifiedly operated at a certain temperature, placing the head section of the shoe lace on the fixed mold and spraying chemical adhesive agents on the outer peripheral face of the shoe lace head section. The roll of film is then fed to a space between the fixed mold and the movable mold by a clamping seat through a predetermined path. Thereafter, the movable mold is moved toward the fixed mold to mate therewith and cut off the film into a segment of film having a certain length with the necessary colorful pictures. Finally, and then the head section of the shoe lace is wrapped and fastened by the segment of the film to form a fastening sheath for the shoe lace head. At this time, the chemical adhesive agent will be released to corrode and evaporize the ink of the pictures. This makes the pictures detach from the fastening sheath and gives the fastening sheath a poor appearance.

OBJECT AND SUMMARY OF THE INVENTION

It is therefore a primary object of the present invention to provide a processing method for undetachably printing pictures on the surface of a fastening sheath for a shoe lace head, in which after one side of a roll of film is printed with necessary colorful pictures by general ink, two liquid transparent inks are further printed onto this side as a protective coating for protecting the colorful pictures from being corroded and evaporized by chemical adhesive agents released when the head section of the shoe lace is wrapped and fastened by the segment of the film to form a fastening sheath.

The present invention can be best understood through the following description and accompanying drawings, wherein:

DETAILED DESCRIPTION OF THE PREFERRED EMBODIMENT

Figure 1:
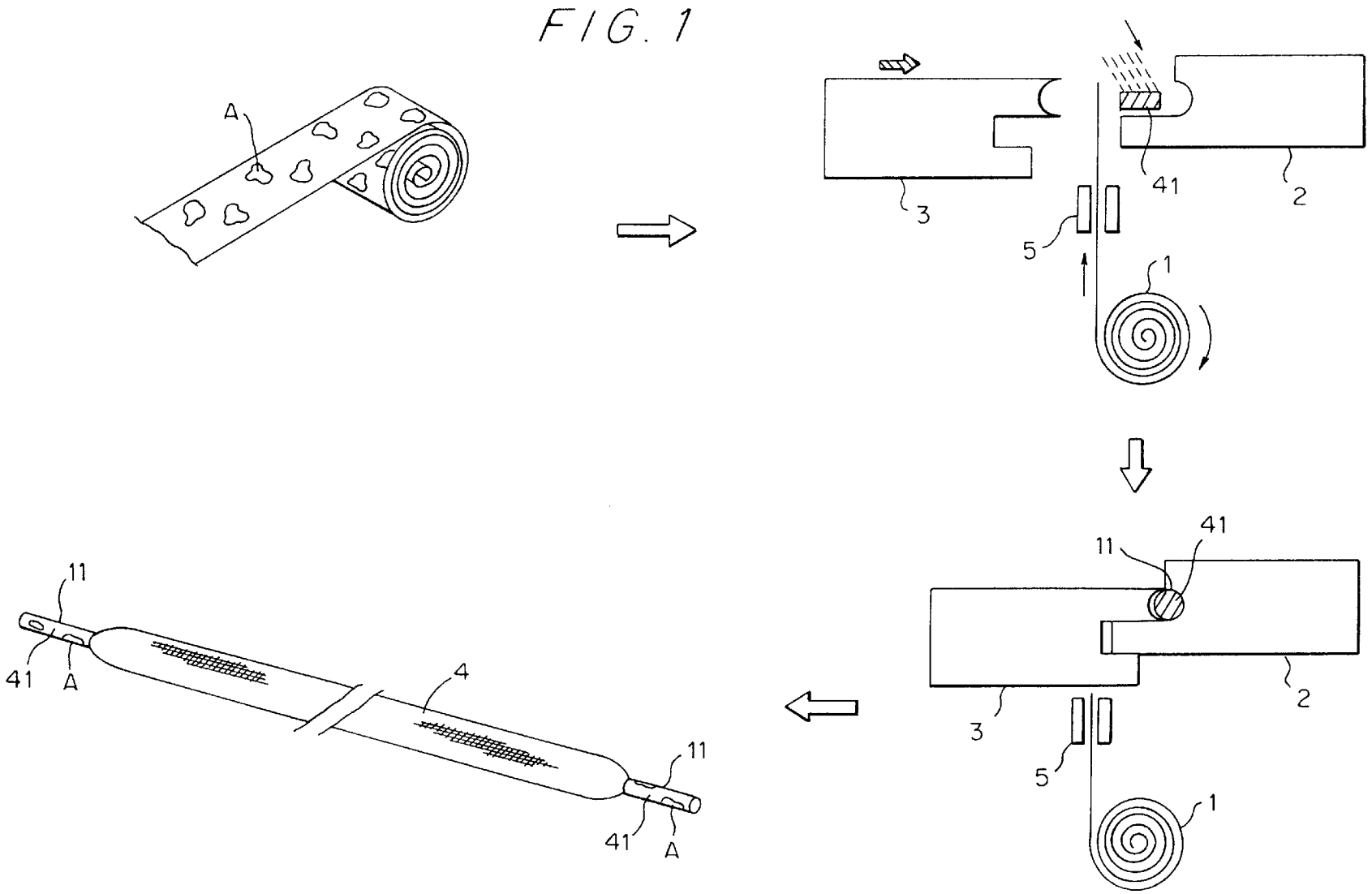
FIG. 1 shows the processing procedure of the present invention.
Figure 2:
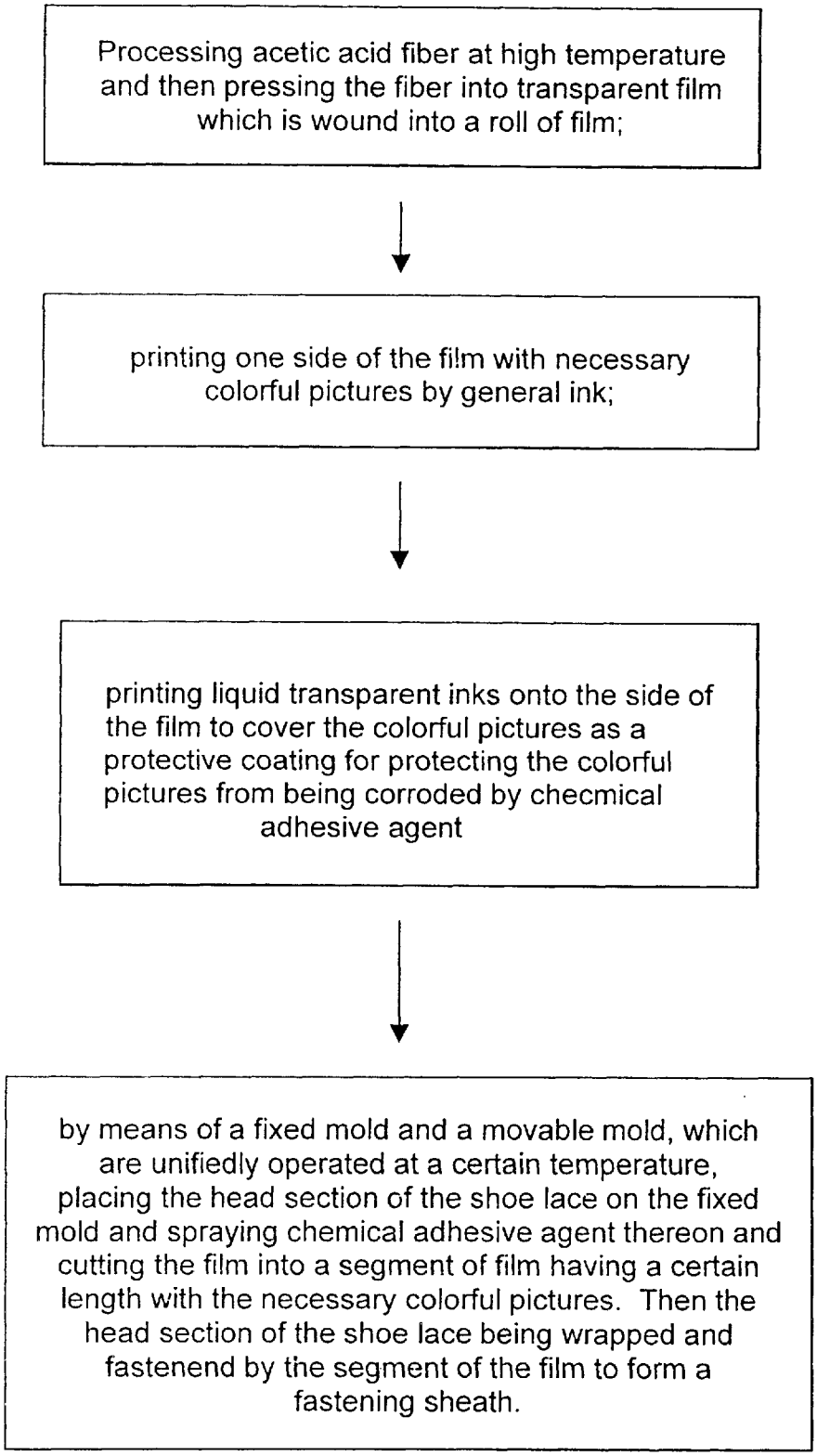
FIG. 2 is a block flow chart, of the present invention.

Please refer to FIGS. 1 and 2 which shows the procedure of the present invention and the flow chart thereof.

The method of the present invention includes the steps of:

1. Processing acetic acid fiber at high temperature and then pressing the fiber into transparent film which is wound into a roll of film 1;

2. Printing one side of the film I with necessary colorful pictures A by general ink printing technique;
3. Printing two liquid transparent inks on the side of the film 1 to cover the colorful pictures A as a protective coating for protecting the colorful pictures A from being corroded by chemical adhesive agents such as MEK, acetone, toluene, etc., whereby the colorful pictures A are ensured not to be evaporized when wrapping and fastening the shoe lace head; and
4. by means of a fixed mold 2 and a movable mold 3, which are unifiedly operated at a certain temperature, placing the head section 41 of the shoe lace 4 on the fixed mold 2 and spraying chemical adhesive agents such as MEK, acetone, toluene, etc. thereon. The roll of film 1 is fed to a space between the fixed mold 2 and the movable mold 3 by a clamping seat 5 through a predetermined path. Then the movable mold 3 is moved toward the fixed mold 2 to mate therewith and cut off the film 1 into a segment of film having a certain length with the necessary colorful pictures A. Then the head section 41 of the shoe lace 4 is wrapped and fastened by the segment of the film to form a fastening sheath 11 for the shoe lace head. Accordingly, the colorful pictures on the surface of the fastening sheath 11 will not detach therefrom.

The above embodiment is only an example of the present invention and the scope of the present invention should not be limited to the example. Any modification or variation derived from the example should fall within the scope of the present invention.

What is claimed is:

1. A method for undetachably printing pictures on a surface of a fastening sheath for a shoe lace head, comprising the steps of:

processing acetic acid fiber at a high temperature;

pressing the fiber into a transparent film which is wound into a roll of film;

printing one side of the film with colorful pictures by an ink printing technique;

printing two liquid transparent inks onto the side of the film to cover the colorful pictures as a protective coating for protecting the colorful pictures from being corroded by chemical adhesive agents and for ensuring that the colorful pictures will not evaporate when wrapping and fastening the shoe lace head;

providing a clamping seat, and a fixed mold and a movable mold which are both operated at a certain temperature;

placing the head section of the shoelace on the fixed mold;

spraying the head section with a chemical adhesive agent from the group consisting of MEK, acetone, and toulene;

feeding the roll of film to a location between the fixed mold and the movable mold by means of the clamping seat;

moving the movable mold toward the fixed mold to mate therewith and cut off the film into a segment of film;

wrapping and fastening the head section of the shoe lace with the segment of the film to form a fastening sheath for the shoe lace head.

* * * * *